US007472670B2

(12) United States Patent
Sugiura et al.

(10) Patent No.: US 7,472,670 B2
(45) Date of Patent: Jan. 6, 2009

(54) VALVE TIMING CONTROLLER

(75) Inventors: Taei Sugiura, Anjo (JP); Eiji Isobe, Kariya (JP); Takayuki Inohara, Okazaki (JP)

(73) Assignees: Denso Corporation (JP); Nippon Soken, Inc. (JP)

( * ) Notice: Subject to any disclaimer, the term of this patent is extended or adjusted under 35 U.S.C. 154(b) by 229 days.

(21) Appl. No.: 11/653,377

(22) Filed: Jan. 16, 2007

(65) Prior Publication Data

US 2007/0163527 A1 Jul. 19, 2007

(30) Foreign Application Priority Data

Jan. 16, 2006 (JP) ..... 2006-007439

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160; 475/331
See application file for complete search history.

(56) References Cited

U.S. PATENT DOCUMENTS

| | | | | |
|---|---|---|---|---|
| 6,799,553 | B1 | 10/2004 | Takenaka et al. | |
| 7,377,242 | B2 * | 5/2008 | Uehama et al. | 123/90.17 |
| 2006/0162683 | A1 | 7/2006 | Sugiura | |

FOREIGN PATENT DOCUMENTS

JP 2005-048706 2/2005

* cited by examiner

*Primary Examiner*—Ching Chang
(74) *Attorney, Agent, or Firm*—Nixon & Vanderhye PC

(57) ABSTRACT

In a valve timing controller, the guide-groove biases the moving element in a direction in which the moving element slides with respect to a radial line connecting a center of the guide-rotational element and the moving element, when the guide-rotational element relatively rotates with respect to the first rotational element. The direction in which the moving elements are pushed and the direction in which the moving elements moves are substantially identical to each other.

10 Claims, 16 Drawing Sheets

VALVE TIMING CONTROLLER

CROSS-REFERENCE TO RELATED APPLICATION

This application is based on Japanese Patent Application No. 2006-7439 filed on Jan. 16, 2006, the disclosure of which is incorporated herein by reference.

FIELD OF THE INVENTION

The present invention relates to a valve timing controller for an internal combustion engine which adjusts valve timing of at least one of an intake valve and an exhaust valve opened/closed by a camshaft on the basis of torque transmission from a crankshaft to the camshaft.

BACKGROUND OF THE INVENTION

A valve timing controller is provide with a planetary gear mechanism and a link mechanism to vary a relative rotational phase between the first rotational element and a second rotational element, which respectively rotate with a crankshaft and a camshaft, so that valve timing of the engine is adjusted.

JP-2005-48706A shows a valve timing controller in which a guide-rotational element is rotated relative to a first rotational element by receiving a planetary movement of an external gear motion. A moving element which engages with a guide-groove of the guide-rotational element rotates an arm member of the link mechanism, whereby the relative rotational phase between the first rotational element and the second rotational element is changed. In this controller, there is a case in which the moving element is tilted relative to the guide-groove due to a clearance gap between the guide-groove and the moving element, which may be generated by manufacturing-tolerance. A friction coefficient between the moving element and the guide-groove increases, and a motion transmitting efficiency from the guide-rotational element to the arm member is deteriorated as shown by dashed lines in FIG. 7, when the valve timing is advanced or retarded. Hence, it may cause an operation-lock of the valve timing controller.

FIG. 16 shows a conventional valve timing controller. When a guide-rotational element 1000 rotates in a retard direction relative to a first rotating element 1002, a guide-groove 1006 biases a moving element 1004 diagonally downward left with respect to the radial line "r" as shown by an arrow Fb. The radial line "r" connects a rotational center "o" of the guide-rotational element 1000 and the moving element 1004. A movement of the moving element 1004 is restricted by the arm member 1008 connecting to the first rotating element 1002, so that the moving element 1004 moves diagonally downward right with respect to the radial line "r" as shown by an arrow Fa. As described above, when the direction in which the moving element 1004 is biased is different from the direction in which the moving element 1004 moves, the moving element 1004 hardly slide smoothly. Especially when the moving element 1004 is tilted, the motion transmitting efficiency is deteriorated.

SUMMARY OF THE INVENTION

The present invention has been made in view of the foregoing problems and an object of the present invention is to provide a valve timing controller which restricts an operation-lock thereof.

According to a valve timing controller of the present invention, the guide-groove biases the moving element in a direction in which the moving element slides with respect to a radial line connecting a center of the guide-rotational element and the moving element, when the guide-rotational element relatively rotates with respect to the first rotational element. The direction in which the moving elements are pushed and the direction in which the moving elements moves are substantially identical to each other. Hence, when the friction coefficient between the moving elements and the guide-grooves is increased due to an inclination of the moving elements with respect to the guide-grooves, a motion transmission efficiency from the guide-rotational element to the each arm members through the moving elements are enhanced. Thus, an operation-lock of the valve timing controller due to the inclination of the moving elements can be restricted.

BRIEF DESCRIPTION OF THE DRAWINGS

Other objects, features, and advantages of the present invention will become more apparent from the following detailed description made with reference to the accompanying drawings, in which like portions are designated by like reference numbers and in which.

DETAILED DESCRIPTION OF EXAMPLE EMBODIMENT

A plurality of embodiments of the present invention will be hereinafter explained with reference to accompanying drawings. Components identical to those in each embodiment are referred to as identical numerals and the same explanation is omitted.

First Embodiment

Figure 2:
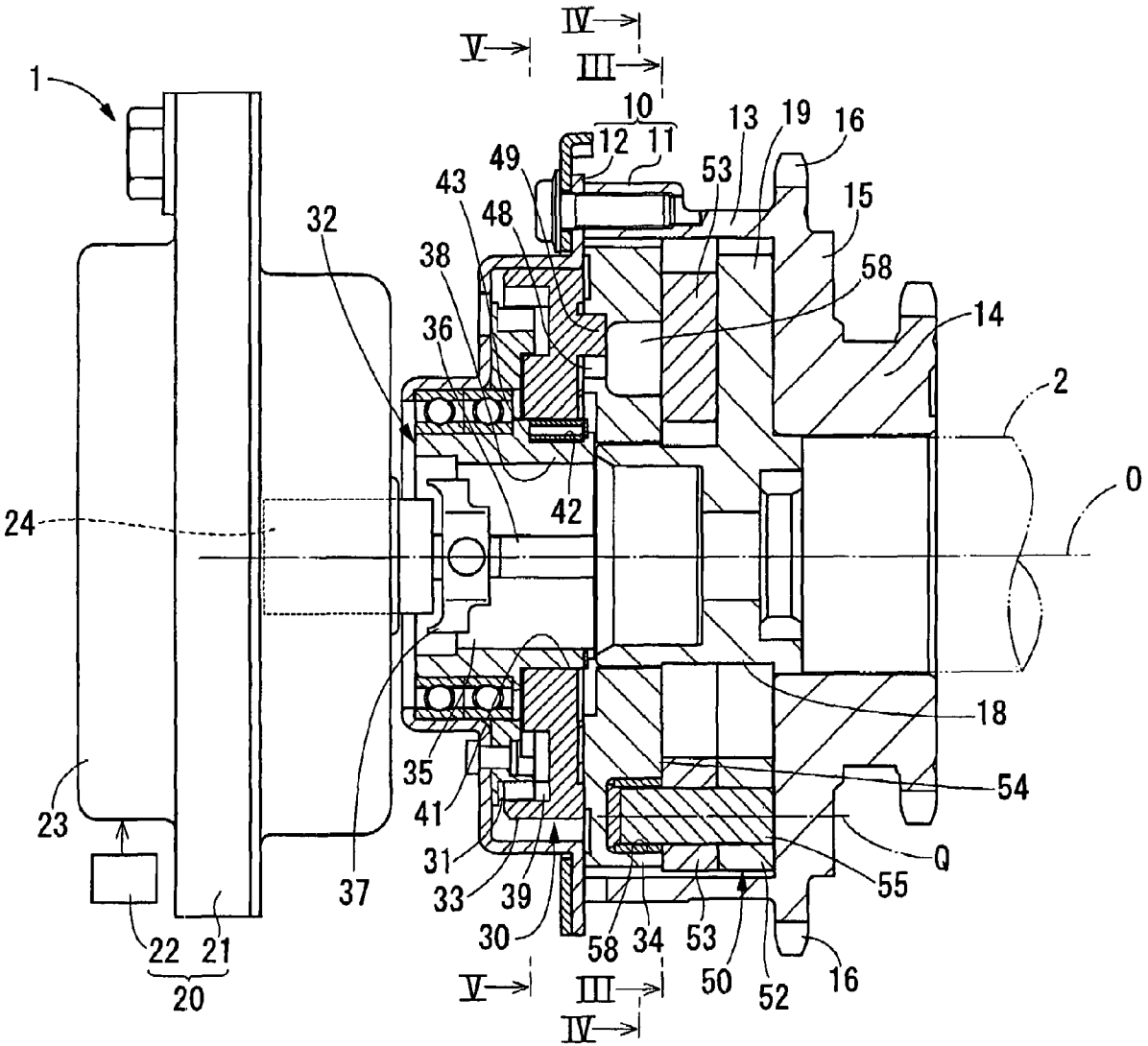
FIG. 2 is a longitudinal sectional view of the valve timing controller taken along a line II-II in FIG. 3.

FIG. 2 shows a valve timing controller 1 in a first embodiment of the present invention. The valve timing controller 1 is provided in a transmission system for transmitting an engine torque from a crankshaft to a camshaft 2 for an internal combustion engine. The valve timing controller 1 changes a relative rotational phase of the camshaft to the crankshaft to adjust valve timing of an intake valve for the engine.

The valve timing controller 1 is provided with a drive-side rotational element 10, a driven-side rotational element 18, a control unit 20, a differential gear mechanism 30 and a link mechanism 50.

The drive-side rotational element 10 is formed in a hollow shape as a whole and receives the differential gear mechanism 30, and the link mechanism 50 therein. The drive-side rotational element 10 includes a two-shoulder cylindrical sprocket 11 and a two-shoulder cylindrical cover gear 12, a large diameter-side end portion of the sprocket 11 being threaded coaxially into a large diameter-side end portion of the cover gear 12. In the sprocket 11, a plurality of teeth 16 are formed in a connecting portion 15 connecting a large diameter portion 13 and a small diameter portion 14 in such a manner as to extend in the outer peripheral side. A circular timing chain is wound around the teeth 16 and a plurality of teeth of the crankshaft. Therefore, when the engine torque outputted from the crankshaft is transmitted through the timing chain to the sprocket 11, the drive-side rotational element 10 rotates around a rotational central line "O" together with rotation of the crankshaft while maintaining the relative rotational phase to the crankshaft. A rotational direction of the drive-side rotational element 10 is equal to a clockwise direction in FIGS. 3 and 4.

Figure 3:
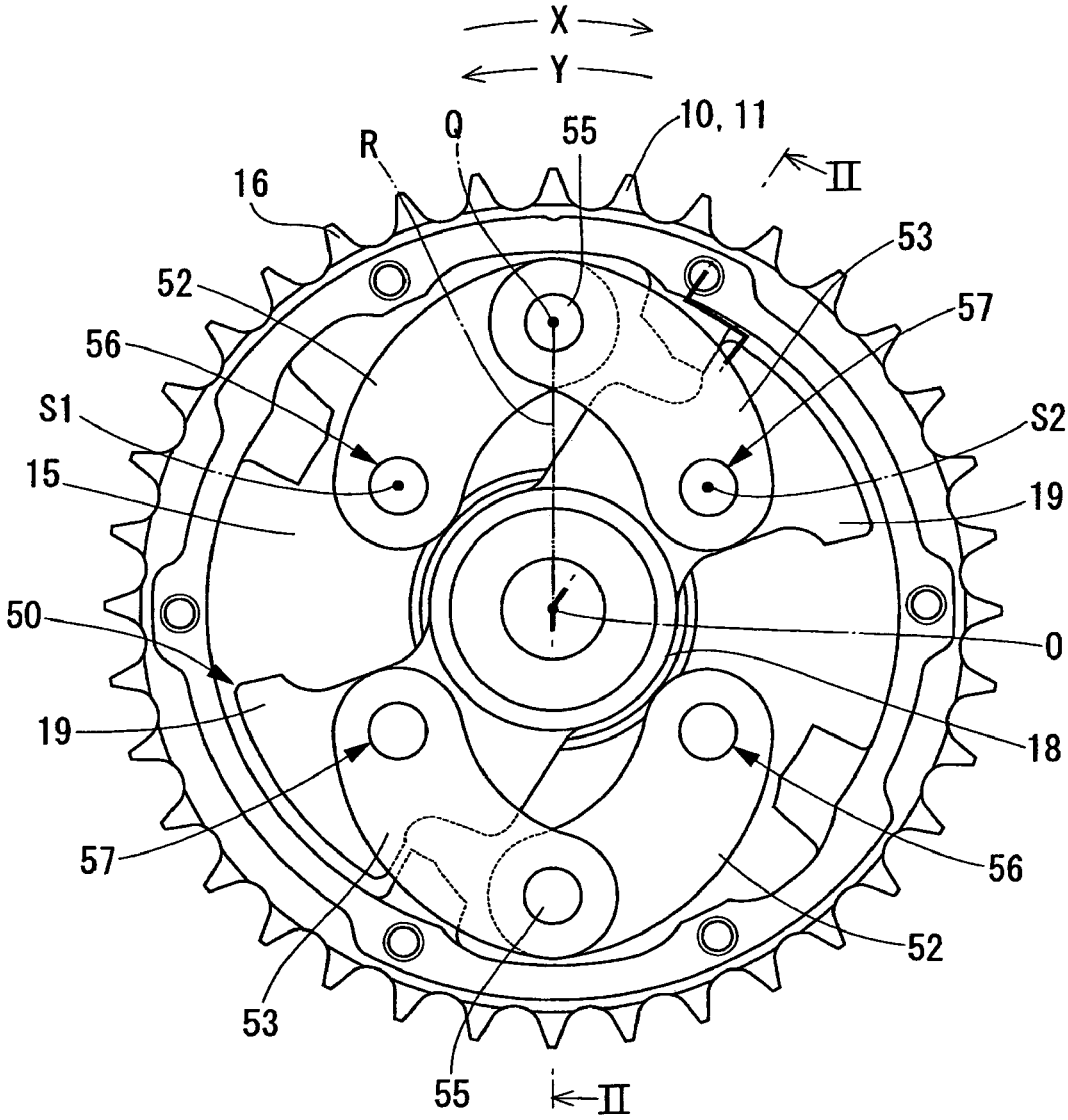
FIG. 3 is a cross sectional view taken along a line III-III in FIG. 2.

As shown in FIGS. 2 and 3, the driven-side rotational element 18 is formed in a cylindrical shape and arranged coaxially with the drive-side rotational element 10 and the camshaft 2. The driven-side rotational element 18 is provided with two link-connecting portions 19, which project opposite direction to each other with respect to the rotational center line "O". One end of the driven-side rotational element 18 is slidably and rotatably engaged with an inner peripheral side of the connecting portion 15 of the sprocket 11 and is fixed to one end of the camshaft 2 by a bolt. Thereby, the driven-side rotational element 18 rotates around a rotational central line "O" together with rotation of the camshaft 2 while maintaining the relative rotational phase to the camshaft 2, and rotates relatively to the drive-side rotational element 10. The relative rotational direction to which the driven-side rotational element 18 advances with respect to the drive-side rotational element 10 is an advance direction X and the relative rotational direction to which the driven-side rotational element 18 retards with respect to the drive-side rotational element 10 is a retard direction Y.

As shown in FIG. 2, the control unit 20 is composed of a combination of an electric motor 21, a power supply control circuit 22 and the like. The electric motor 21 is, for example, a brushless motor and includes a motor case 23 fixed through a stay (not shown) to the engine and a motor shaft 24 supported rotatably/counter-rotatably by the motor case 23. The power supply control circuit 22 is an electrical circuit such as a microcomputer and disposed outside or inside the motor case 23 to be electrically connected to the electric motor 21. The power supply control circuit 22 controls the power supply to a coil (not shown) of the electric motor 21 in response to an operating condition of the engine. This power supply control causes the electric motor 21 to form a rotational magnetic field around the motor shaft 24 and generates a rotational torque in the X and Y directions (refer to FIG. 5) in accordance with the directions of the rotational magnetic field in the motor shaft 24.

As shown in FIGS. 2 and 3, the differential gear mechanism 30 is composed of a combination of an external gear 31, a planetary carrier 32, an internal gear 33, and a guide-rotational element 34.

The external gear 31 is connected to the cover 12 by means of rivets. The external gear 31 rotates with the drive-side rotational element 10. A tip circle of the external gear 31 is located in an outer peripheral side of a root circle thereof. Therefore, when the engine torque is transmitted to the sprocket 11, the cover gear 12 rotates around a rotational central line "O" together with rotation of the crankshaft while maintaining the relative rotational phase to the crankshaft.

The planetary carrier 32 is formed in a cylindrical shape as a whole and includes an inner peripheral surface 35 formed in a cylindrical shape coaxially with the drive-side rotational element 10. A groove portion 36 is opened to the inner peripheral surface 35 of the planetary carrier 32 and the motor shaft 24 is fixed to the planetary carrier 32 coaxially with the inner peripheral surface 35 by a coupling 37 coupled to the groove portion 36. This fixation allows the planetary carrier 32 to rotate around a rotational central line "O" together with rotation of the motor shaft 24 and rotate relatively to the drive-side rotational element 10.

An eccentric cam portion 38 in the planetary carrier 32 provided at a side opposed to the motor shaft 24 includes a cylindrical outer peripheral surface 40 eccentric to the drive-side rotational element 10.

The internal gear 33 is formed in a cup shape and includes a gear portion 39 of which a tip circle is arranged in an inner peripheral side of a root circle. In the internal gear 33, the root circle of the gear portion 39 is larger than the tip circle of the external gear 31 and the tooth number of the gear portion 39 is larger by one than that of the external gear 31. The gear portion 39 is arranged outside of the external gear 31 eccentrically relative to the rotational central dine "O". The gear portion 39 engages with the external gear 31 in the eccentric side of the external gear 31. A central bore 41 of the internal gear 33 is formed in a cylindrical bore shape coaxially with the gear portion 39. An inner peripheral surface of the central bore 41 slidably and rotatably engages with the outer peripheral surface of the eccentric cam portion 38. According to the above arrangement, the internal gear 33 realizes a planetary motion in such a manner that it self-rotates around the eccentric central line "P" of the outer peripheral surface 40 eccentric to the rotational central line "O" while performing an orbital motion in the rotational direction of the eccentric cam portion 38. The eccentric cam portion 38 is provided with a concave portion 42 in which a U-shaped plate spring 43 is accommodated. The U-shaped plate spring 43 biases an inner surface of the central bore 41 of the internal gear 33 toward the external gear 31, so that the internal gear 33 engages with the external gear 31 sufficiently.

Figure 4:
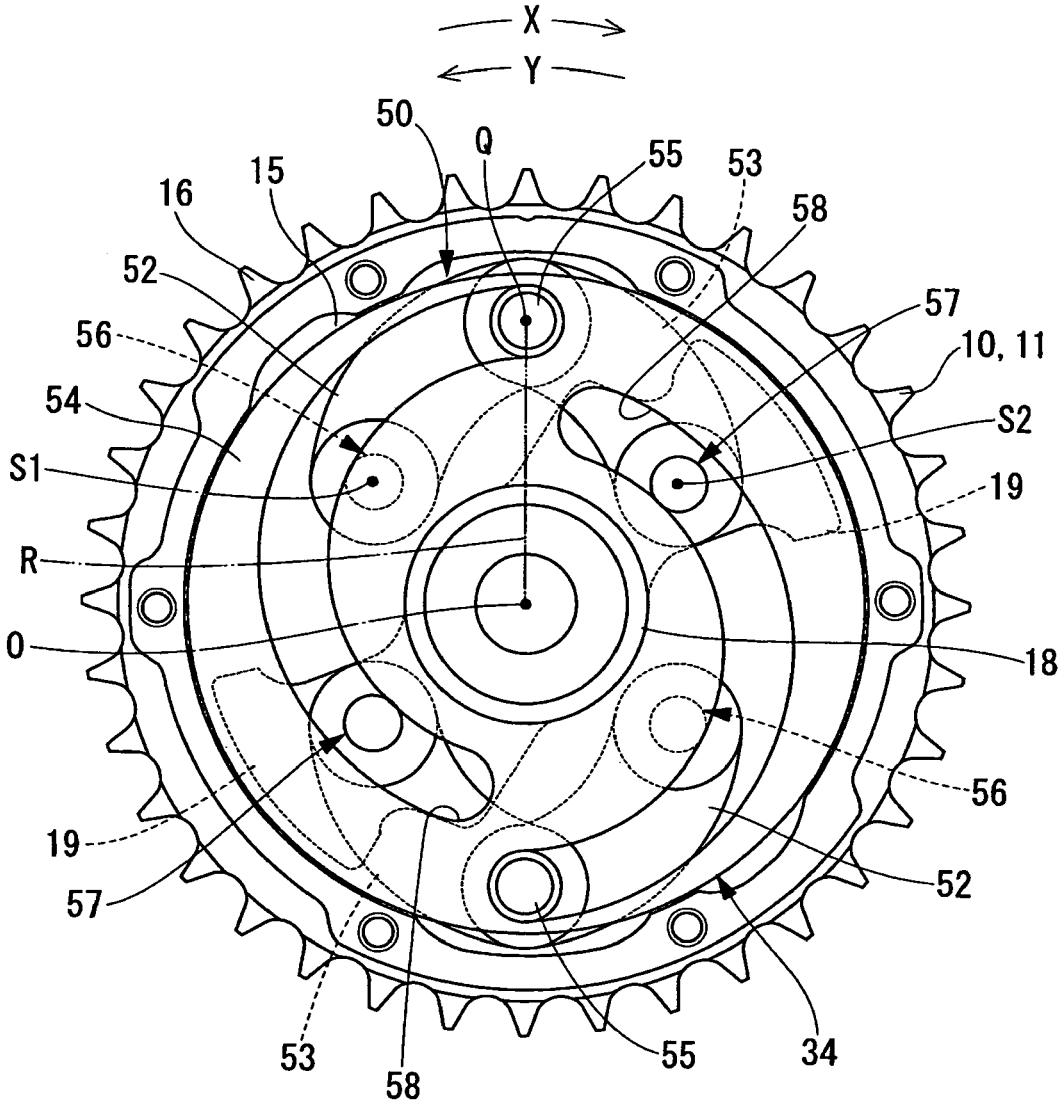
FIG. 4 is a cross sectional view taken along a line IV-IV in FIG. 2.
Figure 5:
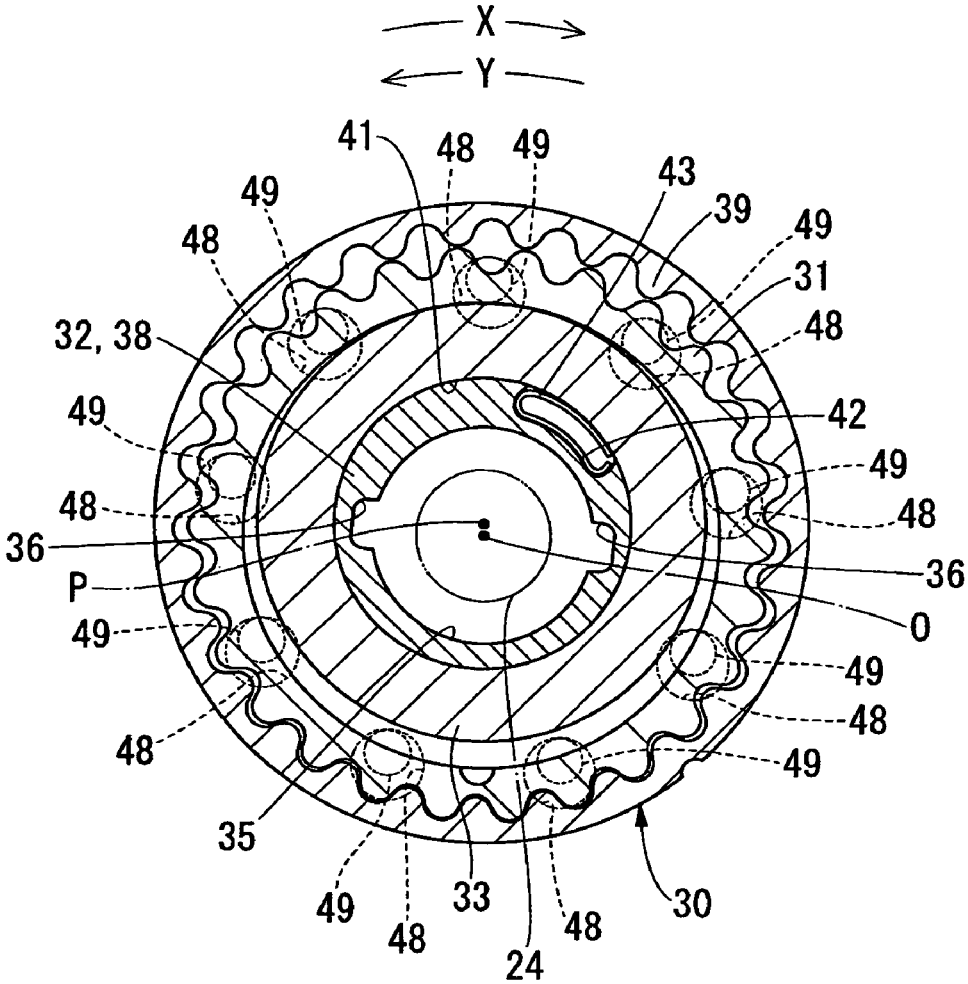
FIG. 5 is a cross sectional view taken along a line V-V in FIG. 2.

As shown in FIGS. 2 and 4, the guide-rotational element 34 is formed in a circular plate shape coaxially with the drive-side rotational element 10 and slidably and rotatably engages with the driven-side rotational element 18 at an outer peripheral side of an end opposed to the camshaft 2. This allows the guide-rotational element 34 to rotate around the rotational central line "O" and rotate relatively to the rotational elements 10 and 18. As shown in FIGS. 2 and 5, cylindrical-bore shaped engagement bores 48 are formed at a plurality of locations (here, nine locations) spaced by equal intervals in the circumferential direction of the guide-rotational element 34. In response to it, a columnar engagement projections 49 are formed at a plurality of locations (here, nine locations) spaced by equal intervals in the circumferential direction of the internal gear 33, where the projections 49 enter into the corresponding engagement bores 48 for engagement.

In the differential gear mechanism 30 with this structure, when the planetary carrier 32 does not rotate relative to the drive-side rotational element 10, the internal gear 33 rotates with the drive-side rotational element 10 without the planetary motion and the engagement projection 49 presses the engagement bore 48 in the rotational side. As a result, the guide-rotational element 34 rotates in the clockwise direction in FIG. 5 while maintaining the relative rotational phase to the drive-side rotational element 10.

When the planetary carrier 32 rotates relatively in the advance direction Y to the drive-side rotational element 10 due to an increasing rotational torque of the motor 21 in the direction X, the internal gear 33 performs a planetary motion while changing an engagement tooth thereof with the external gear portion 31 in the circumferential direction. Thereby, a force with which the engagement projection 49 presses the engagement bore 48 in the rotational side increases. As a result, the guide-rotational element 34 rotates relatively in the advance direction X to the drive-side rotational element 10. On the other hand, when the planetary carrier 32 rotates relatively in the retard direction Y to the drive-side rotational element 10 due to an increasing rotational torque of the motor 21 in the direction Y or an abnormal stop of the motor 21 while the engine is running, the internal gear 33 performs a planetary motion while changing an engagement tooth thereof with the external gear portion 31 in the circumferential direction. Thereby, a force with which the engagement projection 49 presses the engagement bore 48 in the counter-rotational side increases. As a result, the guide-rotational element 34 rotates relatively in the retard direction Y to the drive-side rotational element 10.

The differential gear mechanism 30 generates the planetary motion of the internal gear 33 due to the relative rotational motion of the planetary carrier 32 to the drive-side rotational element 10. The planetary motion is transmitted to the guide-rotational element 34, whereby the guide-rotational element 34 relatively rotates to the drive-side rotational element 10.

Figure 6:
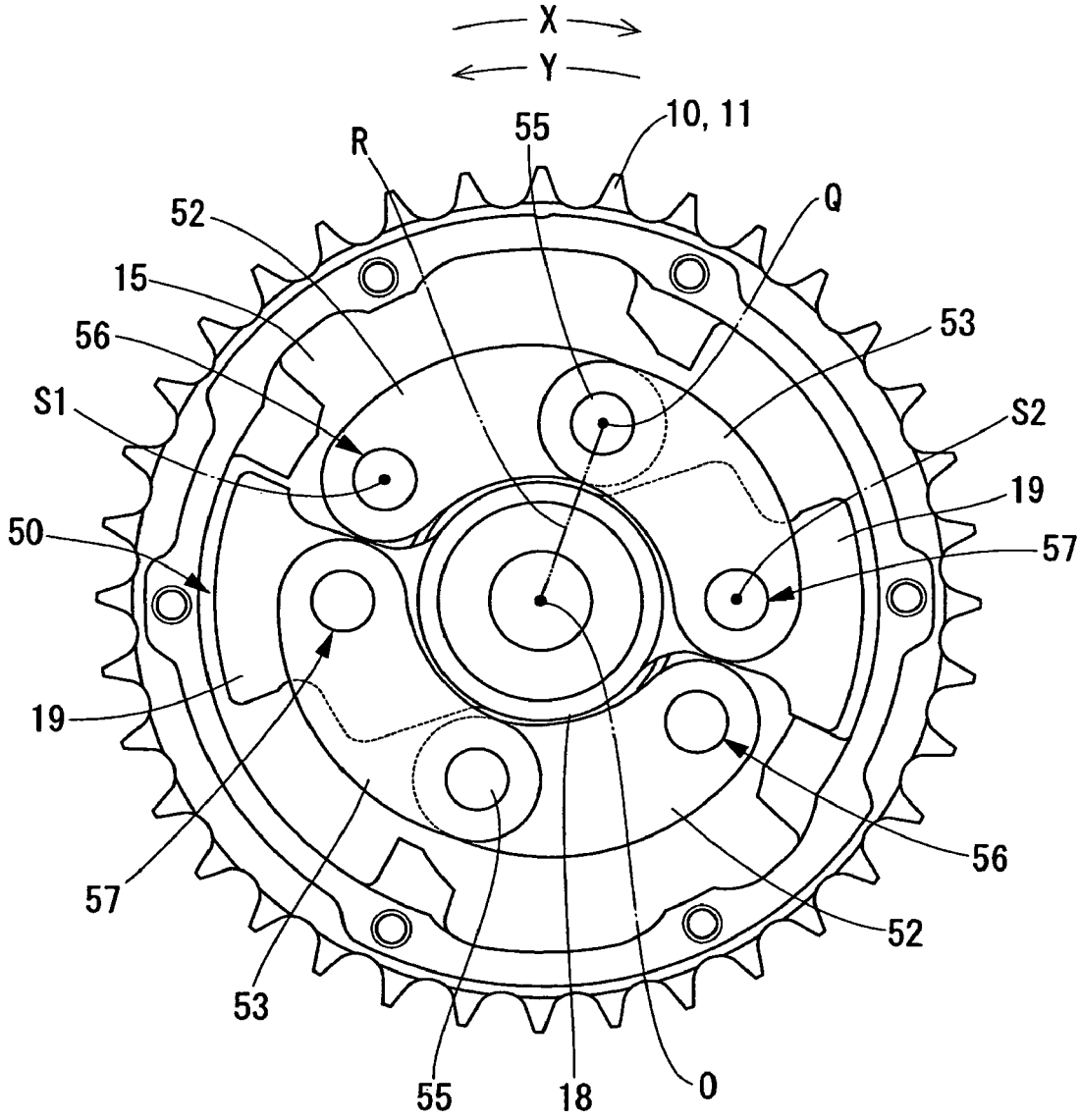
FIG. 6 is a cross sectional view showing an operational condition different from FIG. 3.

As shown in FIGS. 24 and 6, a link mechanism 50 is comprised of a pair of first arm members 52, a pair of second link members 53, a groove-forming portion 54, and a pair of moving elements 55. In FIGS. 3, 4 and 6, a hatching showing a cross section is omitted.

The first arm members 52 are formed in arch-shape and are connected to the connecting portion 15 by a revolute pair at two positions between which the rotational central line "O" is located. The second arm members 53 are formed in arch-shape and are respectively connected to the link-connecting portions 19 by a revolute pair. The second arm members 53 are respectively connected to the corresponding first arm member 19 through the corresponding moving element 55 by a revolute pair. As shown in FIGS. 3 and 6, the revolute pair 56 of the first arm member 53 and the connecting portion 15 and the revolute pair 57 of the second arm member 53 and the link-connecting portion 19 are line-symmetrically arranged to each other with respect to a radial line "R" which connects a center "Q" of the moving element 55 and the rotational central line "O" of the guide-rotational element 34. A ratio between a distance from the center "S1" of the revolute pair 56 to the center "Q" of the moving element 55 and a distance from the center "S2" of the revolute pair 57 to the center "Q" is preferably set from 0.5 to 2. In this embodiment, the ratio is set to substantially 1. That is, the distance from the center "S1" to the center "Q" is substantially equal to the distance from the center "S" to the center "Q".

As shown in FIGS. 2 and 4, the groove-forming portion 54 is defined by an end surface of the guide-rotational element 34, which is opposite side with respect to the internal gear 33. The groove-forming portion 54 has guide-grooves 58 at two positions between which the rotational central line "O" is located. The guide-grooves 58 have uniform width and extend around the line "O". The guide-grooves 58 are curbed with respect to the radial line "R" in such a manner that a distance from the line "O" varies along an extending direction. In this embodiment, the guide-grooves 58 are apart from the line "O" as the guide-grooves 58 extend in the advance direction X.

As shown in FIGS. 2-4, the moving elements 55 are formed in a column shape of which center "Q" is eccentric to the central line "O". One end of each moving element 55 is slidably engaged with the corresponding the guide-groove 58. The other end of each moving element 55 is rotatably engaged with the corresponding first arm member 52. A middle portion of each moving element 55 is press-fitted into the corresponding the second arm member 53. As shown in FIGS. 3 and 6, the moving elements 55 are located in advanced position relative to the corresponding revolute pair 56. A distance from each moving element 55 to the central line "O" is longer than that from the revolute pair 56 to the central line "O".

When the guide-rotational element 34 keeps a relative rotational phase with respect to the drive-side rotational element 10, the moving elements 55 does not slide in the guide-groove 58 and rotates with the guide-rotational element 34. Since the relative position between the revolute pair 56 and the revolute pair 57 with respect to the central line "O" is not varied, the driven-side rotational element 18 rotates clockwise in FIG. 4 while maintaining the relative rotational phase with respect to the drive-side rotational element 10. Hence, the relative rotational phase of the camshaft 2 with respect to the crankshaft, that is, valve timing is maintained at a specific value.

When the guide-rotational element 34 rotates in the advance direction X with respect to the drive-side rotational element 10, the moving elements 55 move in the guide-groove 58 toward the central line "O". The moving elements 55 move the first arm members 52 around the center "S1" of the revolute pair 56 in clockwise direction so that the distance from the center "Q" to the central line "O" decreases. Hence, the moving elements 55 push the second arm elements 53 to rotate the link-connecting portions 19 in the advance direction X. The driven-side rotational element 18 rotates in the advance direction with respect to the drive-side rotational element 10 so that the valve timing is advanced.

When the guide-rotational element 34 rotates in the retard direction Y with respect to the drive-side rotational element 10, the moving elements 55 move in the guide-groove 58 away from the central line "O". The moving elements 55 move the first arm members 52 around the center "S1" of the revolute pair 56 in the counterclockwise direction so that the distance from the center "Q" to the central line "O" increases. Hence, the moving elements 55 pull the second arm members 53 in the retard direction Y with the link-connecting portions 19. The driven-side rotational element 18 rotates in the retard direction with respect to the drive-side rotational element 10 so that the valve timing is retarded.

As described above, the moving elements 55 slide in the guide-grooves 58 according to the relative rotation of the guide-rotational element 34 with respect to the drive-side rotational element 10. The first and the second arm members 52, 53 are respectively driven by the moving elements 55, so that the relative rotational phase between the drive-side rotational element 10 and the driven-side rotational element 18 is varied to change the valve timing.

Figure 1:
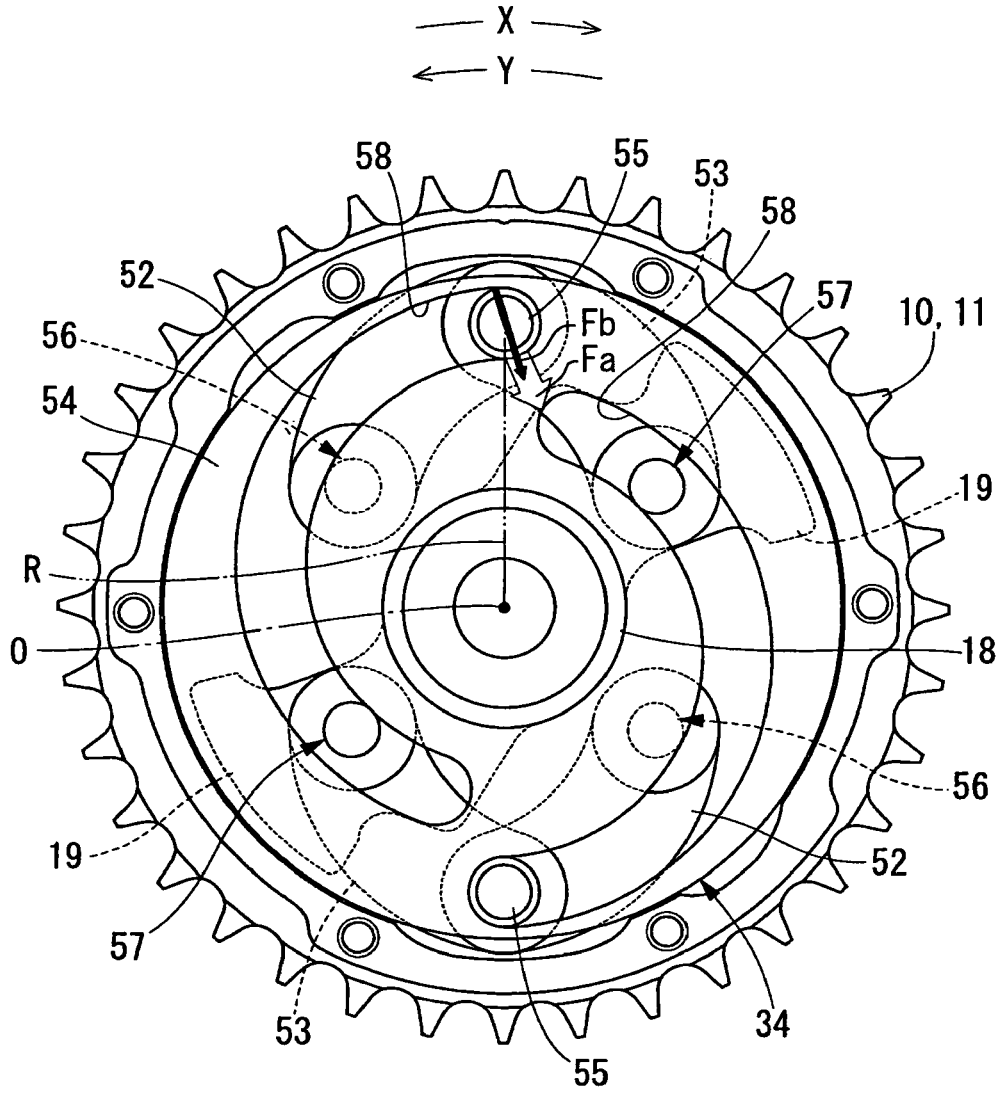
FIG. 1 is a cross sectional view for explaining a feature of the valve timing controller according to a first embodiment.
Figure 7:
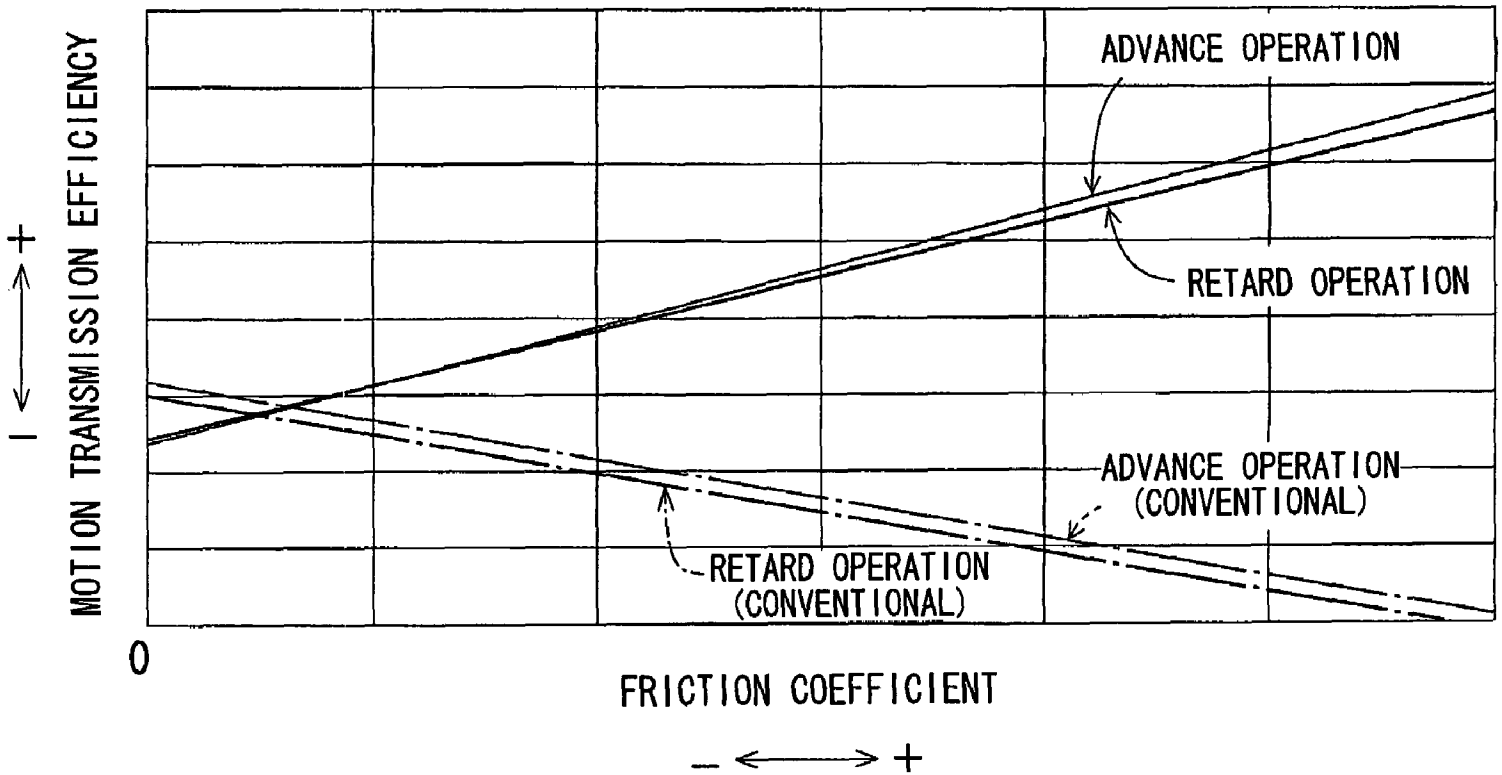
FIG. 7 is a graph for comparing the valve timing controller of the first embodiment with a conventional valve timing controller.

According to the first embodiment, when the valve timing is being advanced as shown in FIG. 1, the moving elements 55 are biased by an inner wall of the guide-grooves 58 toward the central line "O". At this moment, the moving elements 55 receive a force diagonally downward right with respect to the radial line "R" as indicated by an arrow Fb. The radial line "R" passes through the center "Q" of the moving elements 55. Furthermore, the moving elements 55 of which motion is restricted by the first arm member 52 is moving diagonally downward right with respect to the radial line "R" as indicated by an arrow Fa, regardless of the position of the moving elements 55 in the guide-grooves 58. When the direction in which the moving elements 55 are pushed and the direction in which the moving elements 55 are moving are substantially identical to each other, the moving elements 55 can move smoothly. Hence, when the friction coefficient between the moving elements 55 and the guide-grooves 58 is increased due to an inclination of the moving elements 55 with respect to the guide-grooves 58, a motion transmission efficiency from the guide-rotational element 34 to the each arm members 52, 53 through the moving elements are enhanced as shown by solid lines in FIG. 7. Such an enhancement of the motion transmission efficiency can be obtained in the retard operation and the advance operation of the valve timing. Since an operation-lock of the valve timing controller 1 due to the inclination of the moving elements 55 can be avoided, the smooth valve timing control can be achieved.

According to the first embodiment, when the electric motor 21 is abnormally stopped while the engine is running, the planetary carrier 32 is retarded with respect to the drive-side rotational element 10, so that the guide-rotational element 34 is retarded with respect to the drive-side rotational element 10 and the valve timing is retarded through the link mechanism 50. Thus, even if the electric motor 21 is abnormally stopped, the valve timing of an intake valve can be automatically brought to a retarded safe phase where the engine can be started.

Second Embodiment

Figure 8:
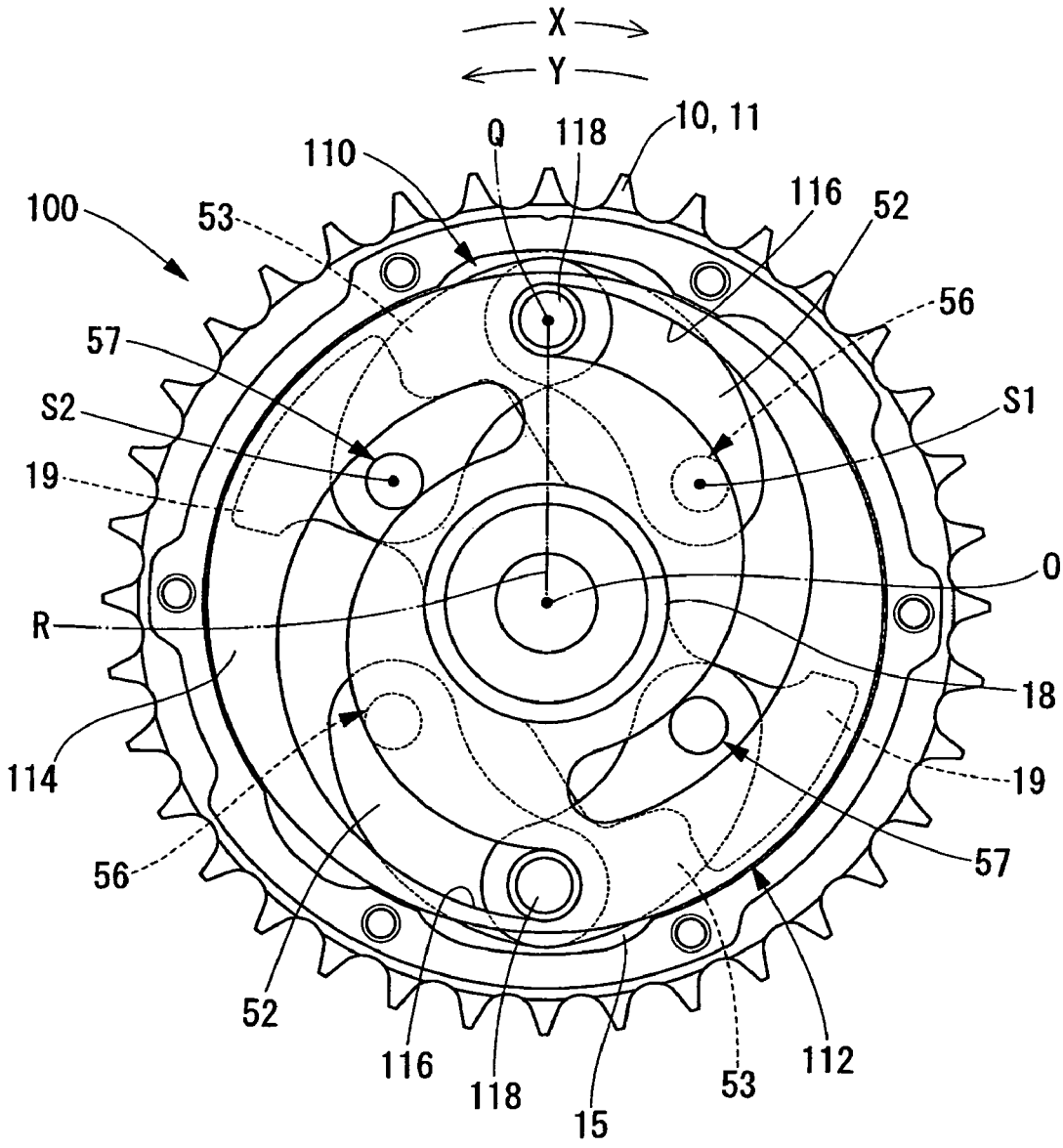
FIG. 8 is a cross sectional view of a valve timing controller according to a second embodiment, which corresponds to FIG. 4.
Figure 9:
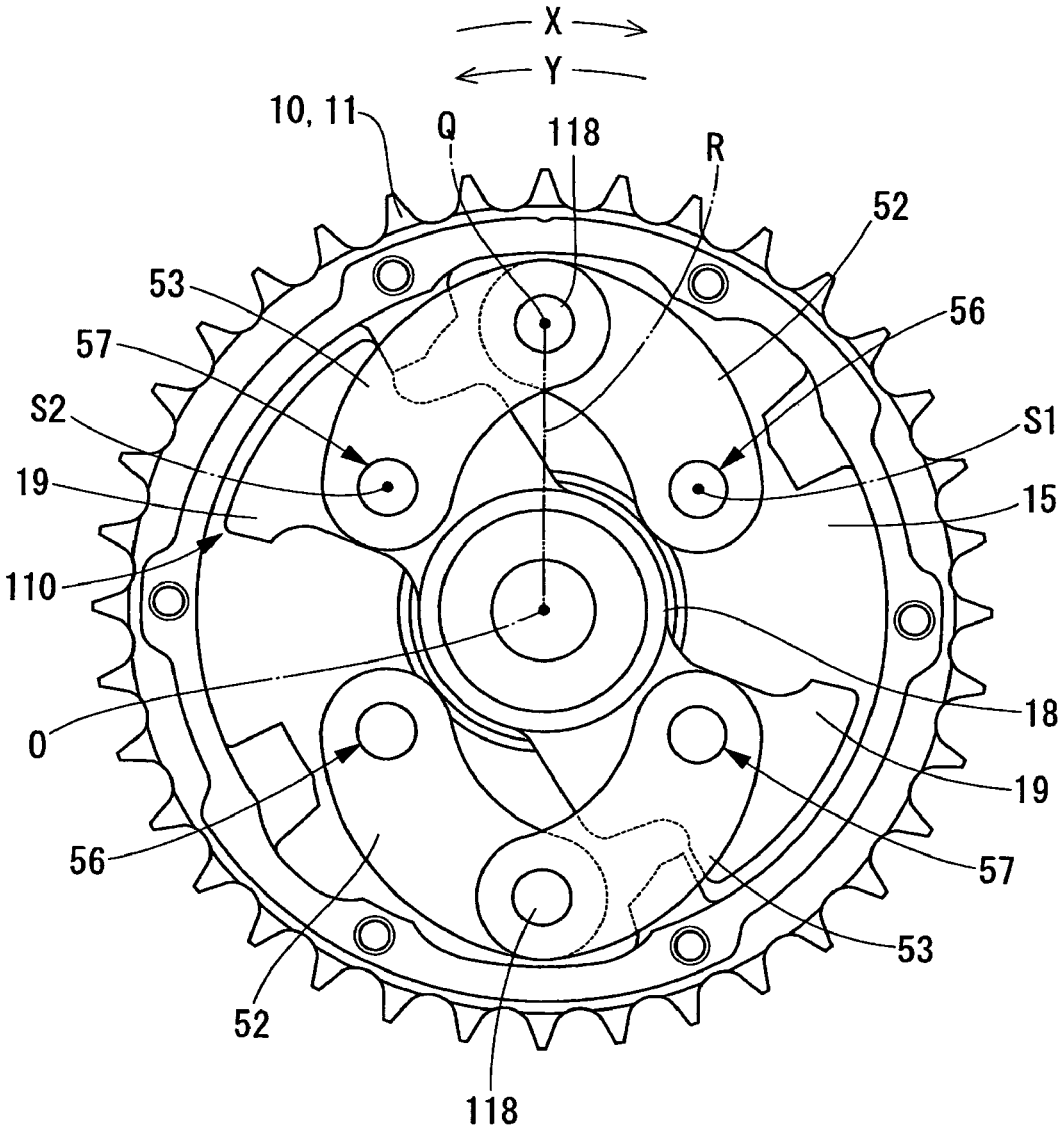
FIG. 9 is a cross sectional view of a valve timing controller according to the second embodiment, which corresponds to FIG. 3.

FIGS. 8 and 9 show a second embodiment, which is a modification of the first embodiment. A pair of guide-grooves 116 are formed in such a manner as to be apart from the central line "O" in the retard direction Y. A moving element 118 engaging with the guide-groove 116 is located at a forward position in the direction Y with respect to the revolute pair 56, and is located apart from the central line "O" more than the revolute pair 56. At any operation-condition of the link mechanism 110, the revolute pair 56 and the revolute pair 57 are line-symmetrically located with respect to the radial line "R". The distance between the center "S1" and the center "Q" and the distance between the center "S2" and the center "Q" are substantially equal to each other.

When the guide-rotational element 112 relatively rotates in the retard direction Y with respect to the drive-side rotational element 10, each moving element 118 slides in each guide-groove 116 in such a manner as to become close to the central line "O". The moving elements 118 move the first arm members 52 around the center "S1" of the revolute pair 56 in counterclockwise direction so that the distance from the center "Q" to the central line "O" decreases. Hence, the moving elements 118 push the second arm elements 53 to rotate the link-connecting portions 19 in the retard direction Y The driven-side rotational element 18 rotates in the retard direction with respect to the drive-side rotational element 10 so that the valve timing is retarded.

When the guide-rotational element 112 relatively rotates in the advance direction X with respect to the drive-side rotational element 10, the moving elements 118 move in the guide-groove 58 away from the central line "O". The moving elements 118 move the first arm members 52 around the center "S1" of the revolute pair 56 in the clockwise direction so that the distance from the center "Q" to the central line "O" increases. Hence, the moving elements 118 pull the second arm members 53 in the advance direction X with the link-connecting portions 19. The driven-side rotational element 18 rotates in the advance direction with respect to the drive-side rotational element 10 so that the valve timing is advanced.

As described above, the moving elements 118 slide in the guide-grooves 58 according to the relative rotation of the guide-rotational element 112 with respect to the drive-side rotational element 10. The first and the second arm members 52, 53 are respectively driven by the moving elements 118, so that the relative rotational phase between the drive-side rotational element 10 and the driven-side rotational element 18 is varied to change the valve timing.

When the guide-rotational element 112 does not rotate relative to the drive-side rotational element 10, the moving element 118 does not slide in the guide-groove 116 so that the valve timing is maintained as it is.

Figure 10:
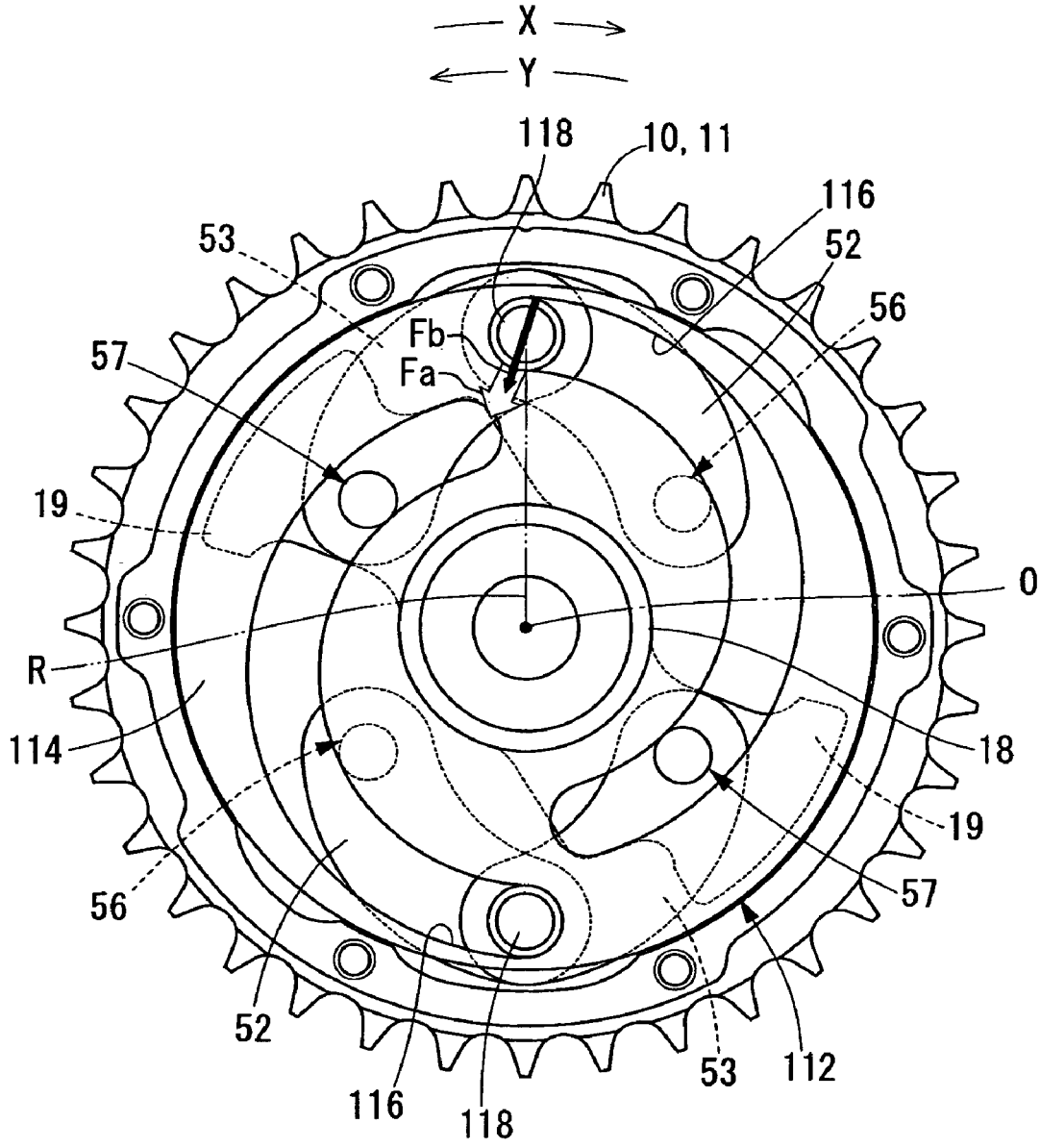
FIG. 10 is a cross sectional view for explaining a feature of the valve timing controller according to a second embodiment.

According to the second embodiment, when the valve timing is being retarded as shown in FIG. 10, the moving elements 118 are biased by an inner wall of the guide-grooves 116 toward the central line "O". At this moment, the moving elements 118 receive a force diagonally downward left with respect to the radial line "R" as illustrated by an arrow Fb. Furthermore, the moving elements 118 of which motion is restricted by the first arm member 52 is moving diagonally downward left with respect to the radial line "R" as illustrated by an arrow Fa, regardless of the position of the moving elements 118 in the guide-grooves 116. When the direction in which the moving elements 118 are pushed and the direction in which the moving elements 118 are moving are identical to each other, the moving elements 118 can move smoothly. Hence, a motion transmission efficiency from the guide-rotational element 112 to the each arm members 52, 53 through the moving elements 118 are enhanced. Such an enhancement of the motion transmission efficiency can be obtained in the retard operation and the advance operation of the valve timing. Since an operation-lock of the valve timing controller 1 due to the inclination of the moving elements 118 can be avoided, the smooth valve timing control can be achieved.

According to the second embodiment, when the electric motor 21 is abnormally stopped while the engine is running, the planetary carrier 32 is retarded with respect to the drive-side rotational element 10, so that the guide-rotational element 34 is retarded with respect to the drive-side rotational element 10 and the valve timing is retarded through the link mechanism 110. Thus, even if the electric motor 21 is abnormally stopped, the valve timing of an intake valve can be automatically brought to a retarded safe phase where the engine can be started.

Third Embodiment

Figure 11:
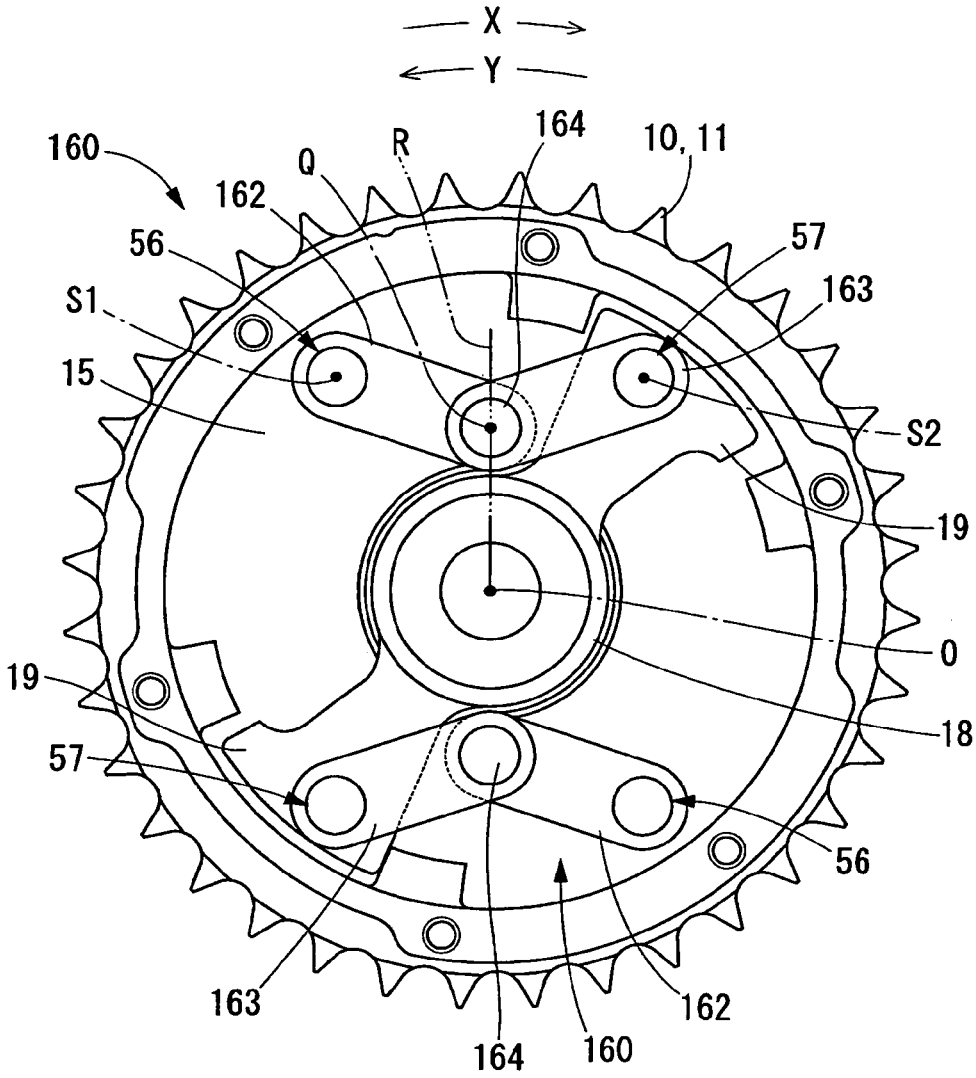
FIG. 11 is a cross sectional view of a valve timing controller according to a third embodiment, which corresponds to FIG. 3.
Figure 12:
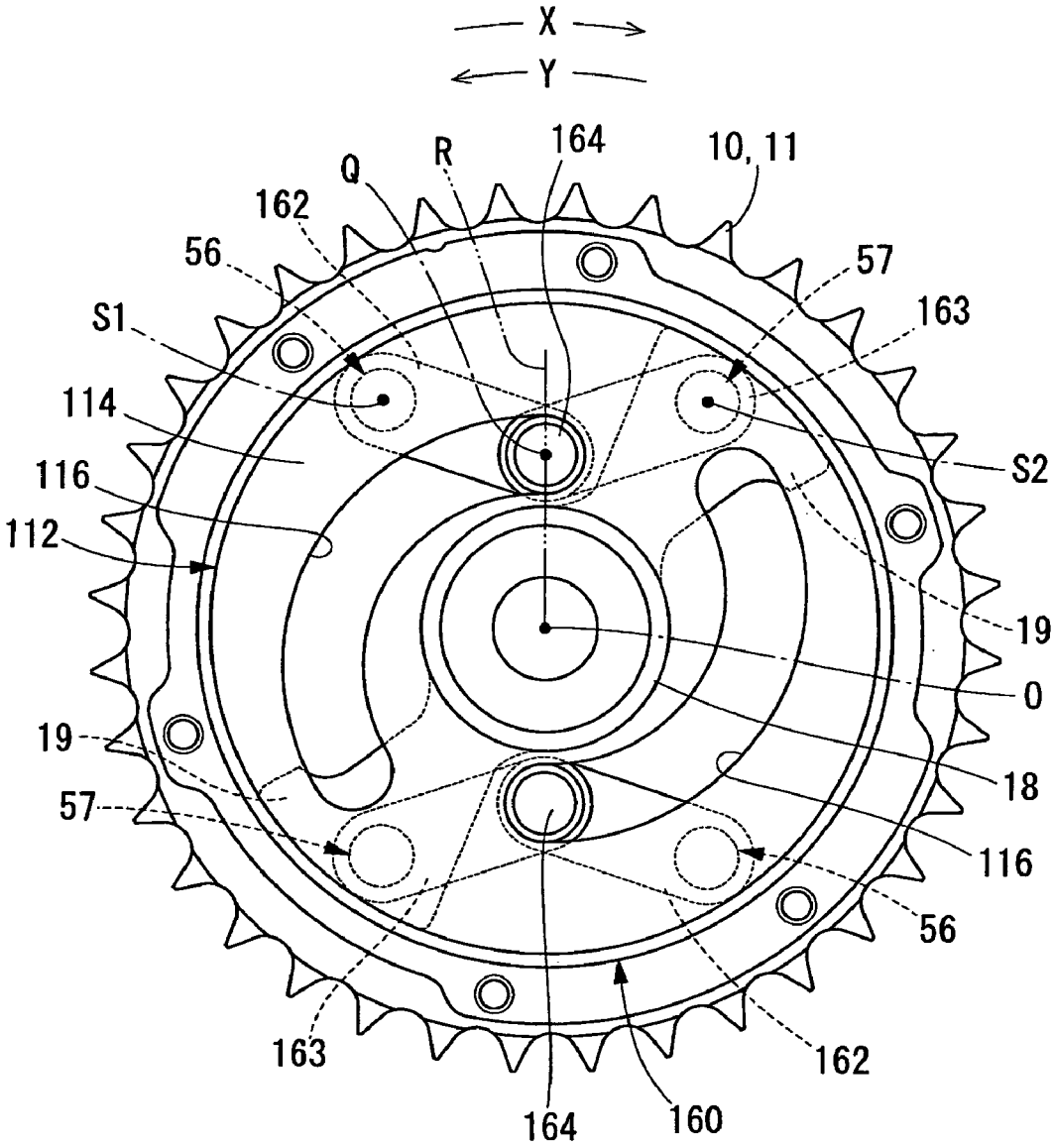
FIG. 12 is a cross sectional view of a valve timing controller according to the third embodiment, which corresponds to FIG. 4.

FIGS. 11 and 12 show a third embodiment, which is a modification of the second-embodiment. A link mechanism 160 of a valve timing controller 150 includes a pair of first arm members 162 and a pair of second arm members 163. These arm members 162 and 163 are formed in I-shape. A moving element 164 engaging with the guide-groove 116 is located at a forward position in the direction X with respect to the revolute pair 56, and is located close to the central line "O" more than the revolute pair 56. At any operation-condition of the link mechanism 160, the revolute pair 56 and the revolute pair 57 are line-symmetrically located with respect to the radial line "R". The distance between the center "S1" and the center "Q" and the distance between the center "S2" and the center "Q" are substantially equal to each other.

When a guide-rotational element 112 rotates in the retard direction Y relative to the drive-side rotational element 10, the moving elements 164 slide in the guide-groove 116 to be close to the central line "O". The moving elements 164 rotate the first arm members 162 clockwise around the center "S1" of the revolute pair 56. The distance between the central line "O" and the center "Q" is decreased. The moving elements 164 pull the second arm members 163 to rotate the link-connecting portions 19 in the retard direction Y The driven-side rotational element 18 is retarded with respect to the drive-side rotational element 10 so that the valve timing is retarded.

When the guide-rotational element 112 rotates in the advance direction X, the moving elements 164 slide in the guide-grooves 116 in a direction apart from the central line "O". The moving elements 164 rotate the first arm members 162 counterclockwise around the center "S1". The distance between the central line "O" and the center "Q" is increased. The moving elements 164 pull the second arm members 163 to rotate the link-connecting portions 19 in the advance direction Y. The driven-side rotational element 18 is advanced with respect to the drive-side rotational element 10 so that the valve timing is advanced.

As described above, the moving elements 164 slide in the guide-grooves 116 according to the relative rotation of the guide-rotational element 112 with respect to the drive-side rotational element 10. The first and the second arm members 162, 163 are respectively driven by the moving elements 164, so that the relative rotational phase between the drive-side rotational element 10 and the driven-side rotational element 18 is varied to change the valve timing.

When the guide-rotational element 112 does not rotate relative to the drive-side rotational element 10, the moving element 164 does not slide in the guide-groove 116 so that the valve timing is maintained as it is.

Figure 13:
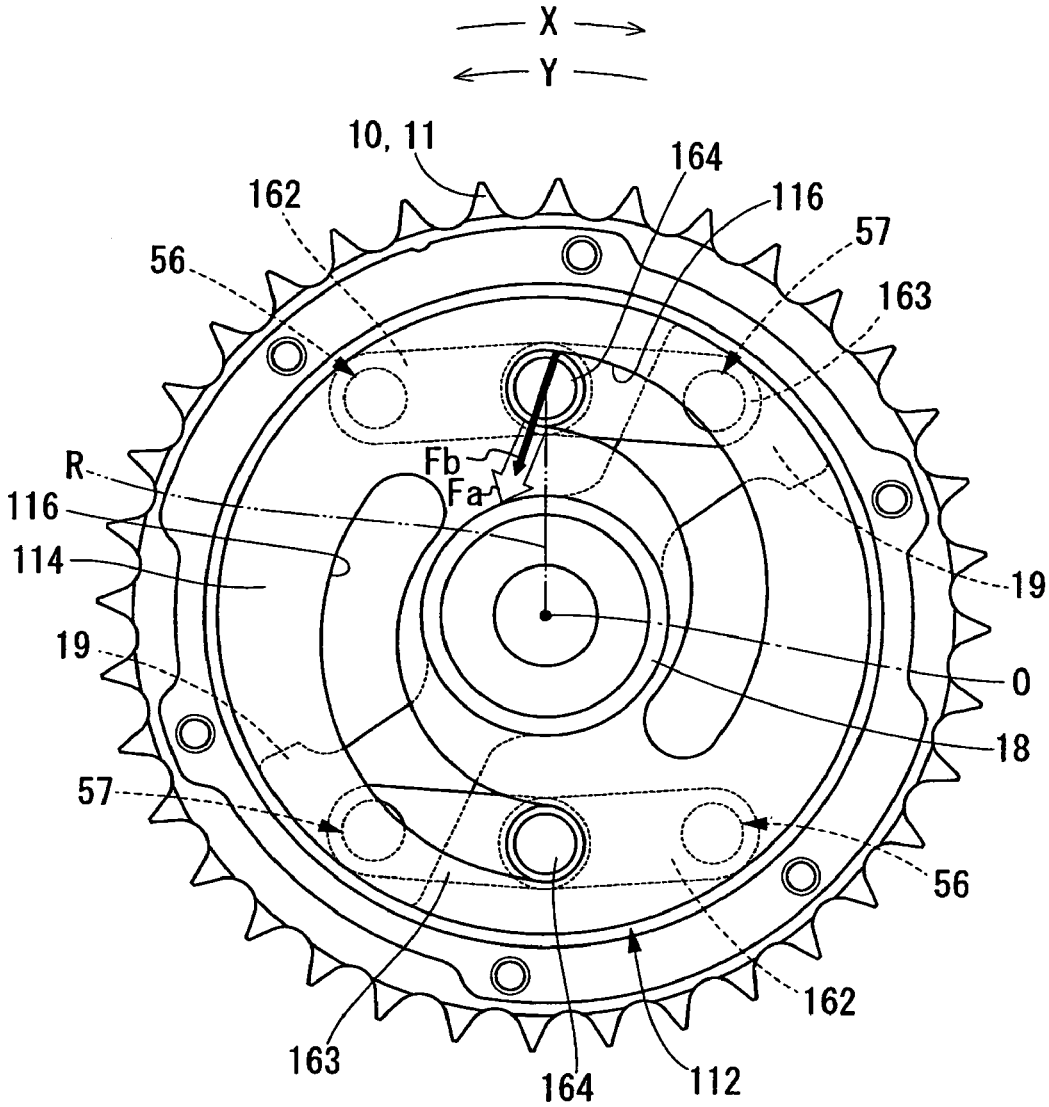
FIG. 13 is a cross sectional view for explaining a feature of the valve timing controller according to the third embodiment.

According to the third embodiment, when the valve timing is being retarded as shown in FIG. 13, the moving elements 164 are biased by an inner wail of the guide-grooves 116 toward the central line "O". At this moment, the moving elements 164 receive a force diagonally downward left with respect to the radial line "R" as illustrated by an arrow Fb. Furthermore, the moving elements 164 of which motion is restricted by the first arm member 162 is moving diagonally downward left with respect to the radial line "R" as illustrated by an arrow Fa, regardless of the position of the moving elements 164 in the guide-grooves 116. When the direction in which the moving elements 164 are pushed and the direction in which the moving elements 164 are moving are identical to each other, the moving elements 164 can move smoothly. Hence, a motion transmission efficiency from the guide-rotational element 112 to the each arm members 162, 163 through the moving elements 164 are enhanced. Such an enhancement of the motion transmission efficiency can be obtained in the retard operation and the advance operation of the valve timing. Since an operation-lock of the valve timing controller due to the inclination of the moving elements 164 can be avoided, the smooth valve timing control can be achieved.

According to the third embodiment, when the electric motor 21 is abnormally stopped while the engine is running, the planetary carrier 32 is retarded with respect to the drive-side rotational element 10, so that the guide-rotational element 112 is retarded with respect to the drive-side rotational element 10 and the valve timing is retarded through the link mechanism 160. Thus, even if the electric motor 21 is abnormally stopped, the valve timing of an intake valve can be automatically brought to a retarded safe phase where the engine can be started.

Fourth Embodiment

Figure 14:
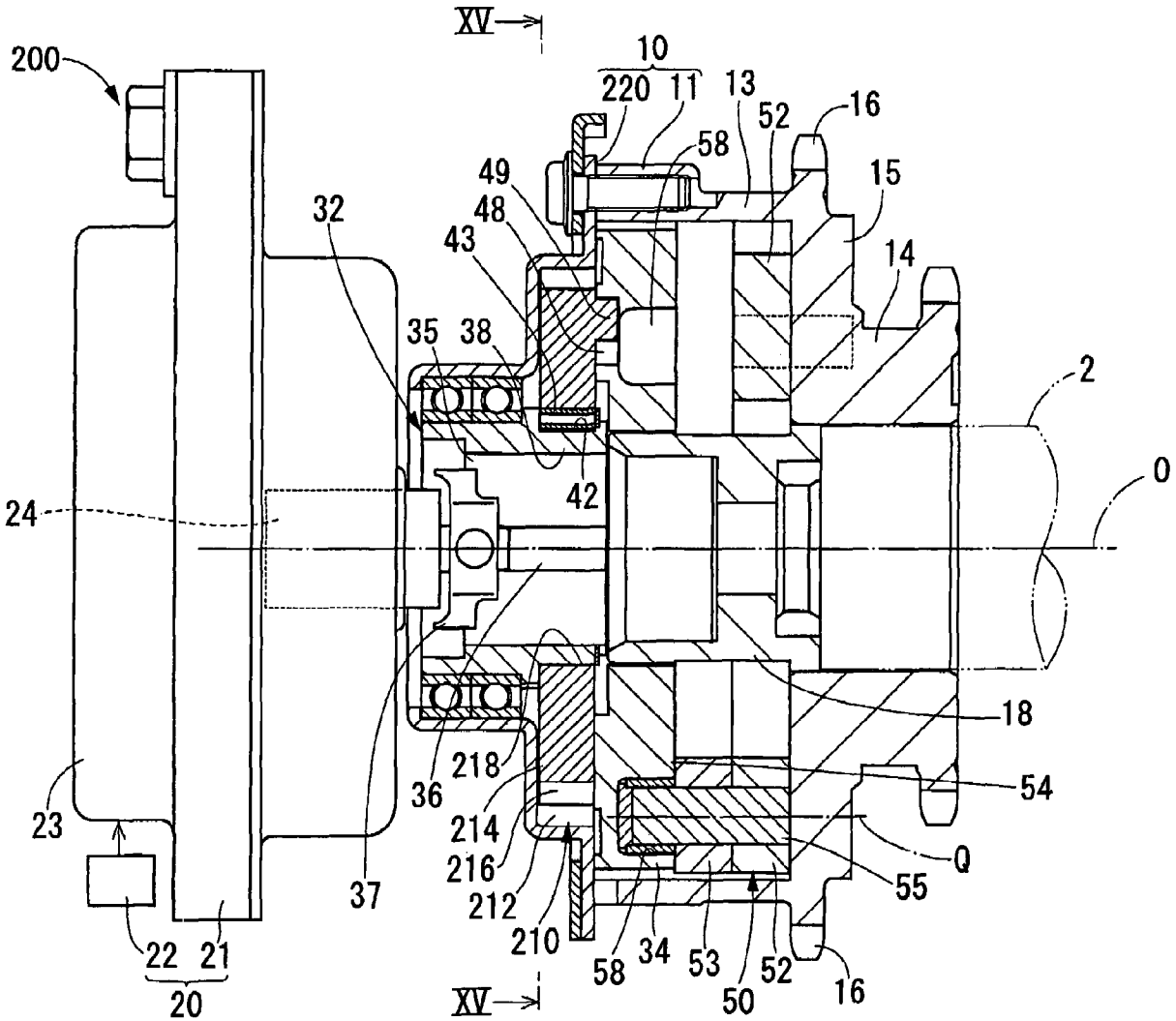
FIG. 14 is a longitudinal sectional view of the valve timing controller according to a fourth embodiment.
Figure 15:
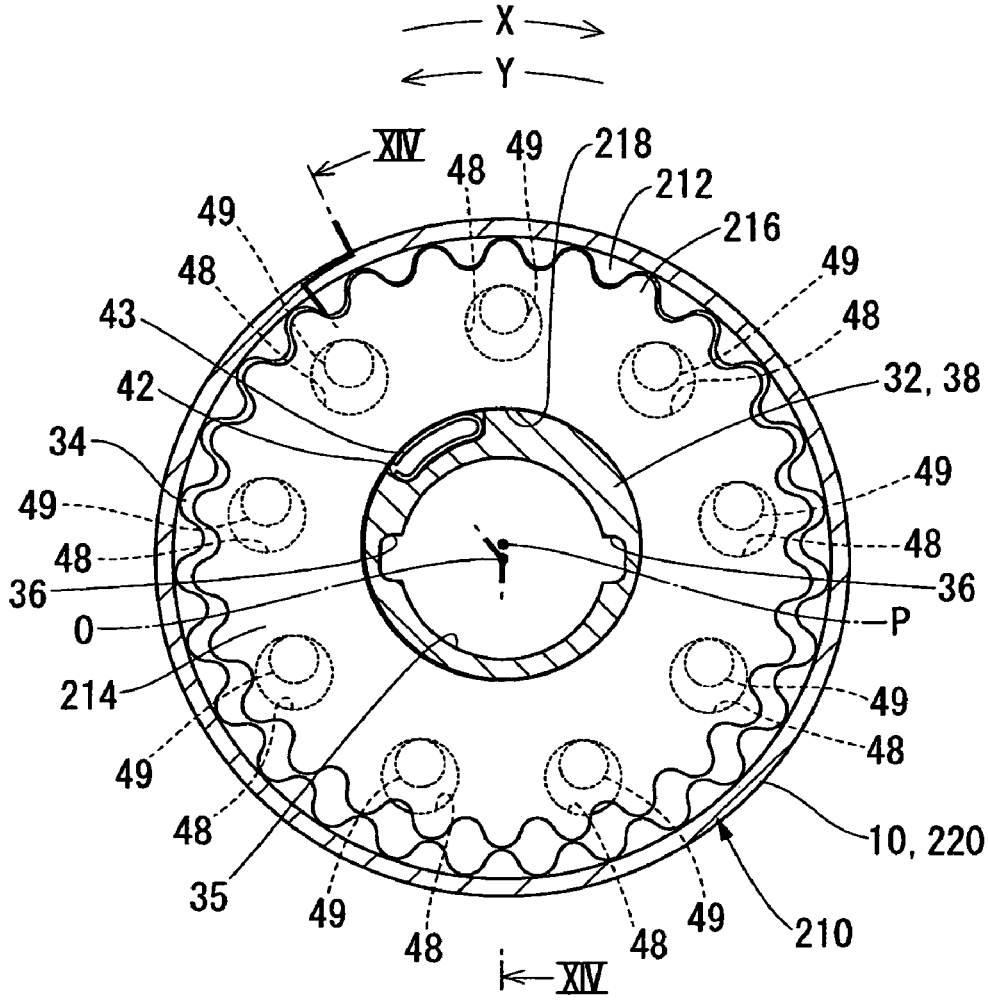
FIG. 15 is a cross sectional view taken along a line XV-XV in FIG. 14.
Figure 16:
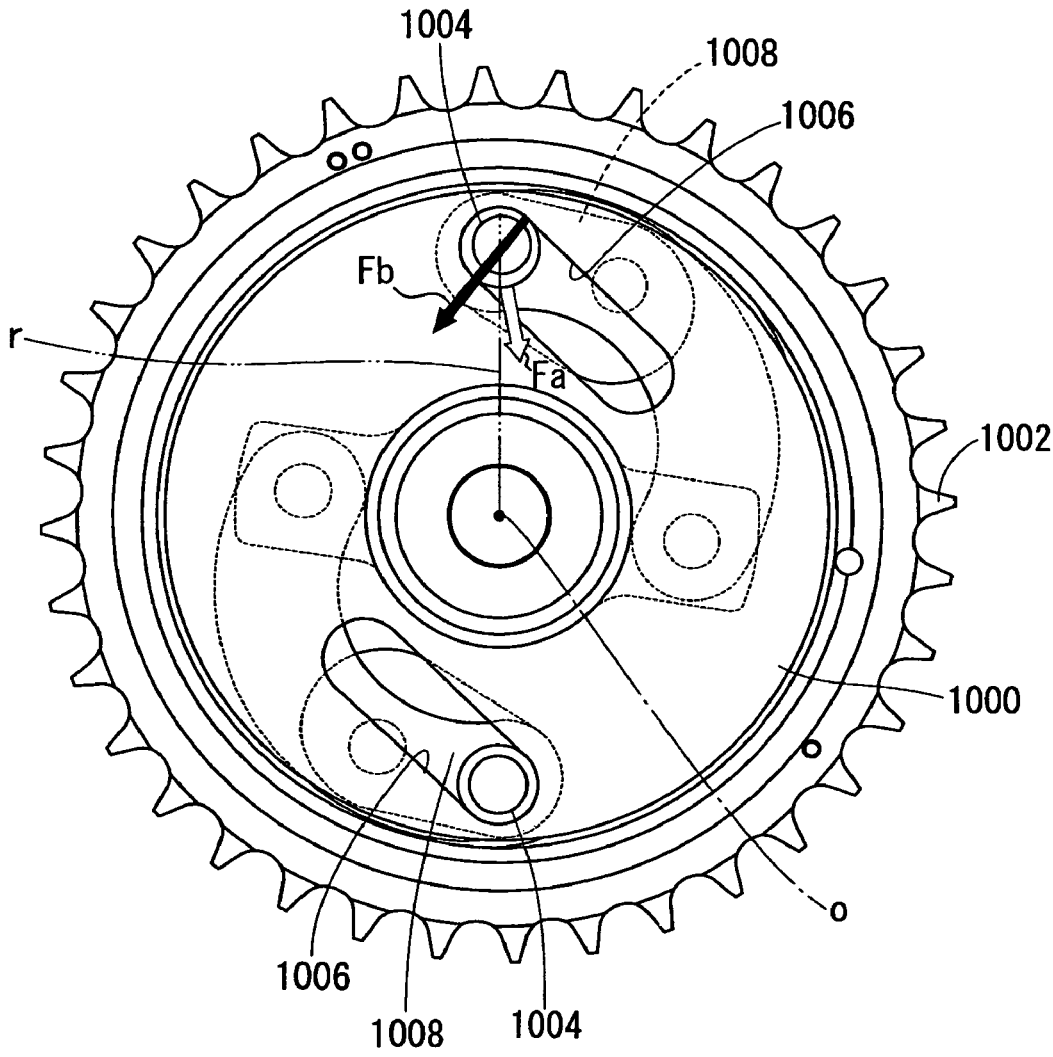
FIG. 16 PRIOR ART
FIG. 16 is a cross sectional view showing a conventional valve timing controller.

FIGS. 14 and 15 show a fourth embodiment, which is a modification of the first embodiment. A valve timing controller 200 adjusts valve timing of an exhaust valve of the engine.

An internal gear 212 is formed integrally with a cover 220. A tip circle of the internal gear 212 is located in an inner peripheral side of a root circle thereof. An external gear 214 is provided with a gear portion 216 of which tip circle is located in an outer peripheral side of a root circle thereof. The tip circle of the gear portion 216 is smaller than a root circle of the internal gear 212. The number of teeth of the gear portion 216 is less by one than that of the internal gear 212. The gear portion 216 is formed coaxially with a center bore 218 of the external gear 214, which is engaged with the eccentric cam portion 38. Hence, the gear portion. 216 is located inside of the internal gear 212 and is eccentric with respect to the central line "O". The gear portion 216 engages with the internal gear 212 in an eccentric direction. The external gear 214 rotates around the center "P" and performs a planetary motion in a rotational direction of the eccentric cam portion 38. The plate spring 43 biases the inner surface of the center bore 218 toward the internal gear 212, so that the external gear 214 engages with the internal gear 212 sufficiently.

In the differential gear mechanism 210 with the above structure, when the planetary carrier 32 rotates relatively in the retard direction Y to the drive-side rotational element 10, the external gear 214 performs a planetary motion while changing an engagement tooth thereof with the internal gear 212 in the circumferential direction. Thereby, a force with which the engagement projection 49 presses the engagement bore 48 in the rotational direction increases. As a result, the guide-rotational element 34 rotates relatively in the advance direction X to the drive-side rotational element 10. On the other hand, when the planetary carrier 32 rotates relatively in the advance direction X to the drive-side rotational element 10, the external gear 214 performs a planetary motion while changing an engagement tooth thereof with the external gear portion 322 in the circumferential direction. Thereby, the engagement projection 49 presses the engagement bore 48 in the counter-rotational direction. As a result, the guide-rotational element 34 rotates relatively in the retard direction Y to the drive-side rotational element 10.

The differential gear mechanism 210 generates the planetary motion of the external gear 214 due to the relative rotational motion of the planetary carrier 32 to the drive-side rotational element 10 to convert the planetary motion into the relative rotational motion of the guide-rotational element 34 to the drive-side rotational element 10.

It should be noted that, when the planetary carrier 32 does not rotate relatively to the-drive-side rotational element 10, the guide-rotational element 34 does not perform the planetary motion the same as in the first embodiment and the guide-rotational element 34 rotates while maintaining the relative rotational phase to the drive-side rotational element 10.

According to the fourth embodiment, when the guide-rotational element 34 rotates in the advance direction with respect to the drive-side rotational element 10, the valve timing of the engine is advanced. When the guide-rotational element 34 rotates in the retard direction with respect to the drive-side rotation element 10, the valve timing of the engine is retarded. The motion transmission efficiency from the guide-rotational element 34 to each arm member 52, 53 is enhanced, so that the valve timing is adjusted smoothly.

According to the fourth embodiment, when the electric motor 21 is abnormally stopped while the engine is running, the planetary carrier 32 is retarded with respect to the drive-side rotational element 10, so that the guide-rotational element 34 is advanced with respect to the drive-side rotational element 10 and the valve timing is advanced through the link mechanism 160. Thus, even if the electric motor 21 is abnormally stopped, the valve timing of the exhaust valve can be automatically brought to an advanced safe phase where the engine can be started.

The present invention is not limited to the above embodiments. In the first to forth embodiments, the valve timing controller can adjust valve timing of the intake valve and the exhaust valve. In the first to third embodiments, the valve timing controller 1, 100, and 150 can adjust the valve timing of the exhaust valve. In the fourth embodiment, the valve timing controller 200 can adjust the valve timing of the intake valve. Furthermore, in the fourth embodiment, the link mechanism 50 can be replaced by the link mechanism 110 of the second embodiment, or the link mechanism 160 of the third embodiment.

In the first to fourth embodiments, the guide-grooves 58, and 116 can be formed straight if the grooves inclined in a similar way of the embodiments. Furthermore, the revolute pair 56 and the revolute pair 57 can be arranged in the same side relative to the radial direction line "R".

The element 10 may rotate with the camshaft 2, and the element 18 may rotate with the crankshaft. Instead of the electric motor 21, an electromagnetic brake apparatus or a hydraulic motor can be used.

What is claimed is:

1. A valve timing controller for an internal combustion engine which adjusts valve timing of at least one of an intake valve and an exhaust valve opened/closed by a camshaft on the basis of torque transmission from a crankshaft to the camshaft, comprising:

a first rotational element rotating in association with the crankshaft;

a second rotational element rotating in association with the camshaft;

an external gear rotating integrally with the first rotational element;

an internal gear performing a planetary motion while engaging with the external gear from a direction of an outer periphery of the external gear;

a guide-rotational element relatively rotating to the first rotational element by receiving the planetary motion of the internal gear, the guide-rotational element being provided with a guide-groove having a constant width and extending on the guide-rotational element;

a moving element engaging with the guide-groove in such a manner as to slide therein when the guide-rotational element relatively rotates to the first rotational element; and a phase changing means including a first arm member connected to the first rotational element by a revolute pair, and a second arm member connected to the second rotational element by a revolute pair and the first arm member by a revolute pair through the moving element, the phase changing means changing a relative rotational phase between the first rotational element and the second rotational element by moving the moving element to rotate the first arm member and the second arm member; wherein when the guide-rotational element relatively rotates with respect to the first rotational element, the guide-groove biases the moving element in a direction in which the moving element slides with respect to a radial line connecting a center of the guide-rotational element and the moving element.

2. A valve timing controller according to claim 1, further comprising an electric motor which generates rotational torque so that the internal gear performs the planetary motion.

3. A valve timing controller according to claim 2, wherein a valve timing of the intake valve is adjusted, further comprising a planetary carrier rotatably supporting the internal gear and relatively rotating with respect to the first rotational element by receiving the rotational torque from the electric motor, wherein when the planetary carrier is retarded relative to the first rotational element by receiving the rotational torque, the internal gear retards the guide-rotational element relative to the first rotational element, whereby the moving element rotates the first arm member and the second arm member so that the second rotational element is retarded relative to the first rotational element.

4. A valve timing controller according to claim 1, wherein a distance between the moving element and a revolute pair formed by the first arm member and the first rotational element is substantially equal to a distance between the moving element and a revolute pair formed by the second arm member and the second rotational element.

5. A valve timing controller according to claim 1, wherein a revolute pair formed by the first arm member and the first rotational element, and a revolute pair formed by the second arm member and the second rotational element are located both sides respectively with respect to the radial line.

6. A valve timing controller according to claim 5, wherein the guide-groove is inclined with respect to the radial line in such a manner that a distance between the center of the guide-rotational element and the moving element decreases when the guide-rotational element is advanced relative to the first rotational element, the moving element is located at a position in which the guide-rotational element is advanced relative to the first rotational element with respect to the revolute pair formed by the first arm member and the first rotational element, and the moving element is located at a position which is far from the center of the guide-rotational element more the revolute pair formed by the first arm member and the first rotational element.

7. A valve timing controller according to claim 5, wherein the guide-groove is inclined with respect to the radial line in such a manner that a distance between the center of the guide-rotational element and the moving element decreases when the guide-rotational element is retarded relative to the first rotational element, the moving element is located at a position in which the guide-rotational element is retarded relative to the first rotational element with respect to the revolute pair formed by the first arm member and the first rotational element, and the moving element is located at a position which is far from the center of the guide-rotational element more the revolute pair formed by the first arm member and the first rotational element.

8. A valve timing controller for an internal combustion engine which adjusts valve timing of at least one of an intake valve and an exhaust valve opened/closed by a camshaft on the basis of torque transmission from a crankshaft to the camshaft, comprising:

a first rotational element rotating in association with the crankshaft;

a second rotational element rotating in association with the camshaft;

an internal gear rotating integrally with the first rotational element;

an external gear performing a planetary motion while engaging with the internal gear from a direction of an inner periphery of the internal gear;

a guide-rotational element relatively rotating to the first rotational element by receiving the planetary motion of the external gear, the guide-rotational element being provided with a guide-groove having a constant width and extending on the guide-rotational element;

a moving element engaging with the guide-groove in such a manner as to slide therein when the guide-rotational element relatively rotates to the first rotational element; and a phase changing means including a first arm member connected to the first rotational element by a revolute pair, and a second arm member connected to the second rotational element by a revolute pair and the first arm member by a revolute pair through the moving element, the phase changing means changing a relative rotational phase between the first rotational element and the second rotational element by moving the moving element to rotate the first arm member and the second arm member; wherein when the guide-rotational element relatively rotates with respect to the first rotational element, the guide-groove biases the moving element in a direction in which the moving element slides with respect to a radial line connecting a center of the guide-rotational element and the moving element.

9. A valve timing controller according to claim 8, further comprising an electric motor which generates rotational torque so that the external gear performs the planetary motion.

10. A valve timing controller according to claim 9, wherein a valve timing of the exhaust valve is adjusted, further comprising a planetary carrier rotatably supporting the external gear and relatively rotating with respect to the first rotational element by receiving the rotational torque from the electric motor, wherein when the planetary carrier is retarded relative to the first rotational element by receiving the rotational torque, the external gear advances the guide-rotational element relative to the first rotational element, whereby the moving element rotates the first arm member and the second arm member so that the second rotational element is advanced relative to the first rotational element.

* * * * *